137-15
3/29/77 XR 4,014,475

United States Patent [19]
Grace et al.

[11] 4,014,475
[45] Mar. 29, 1977

[54] COMBINED MANWAY AND COLLECTION TANK FOR SEWAGE GRINDER

[75] Inventors: Richard C. Grace, Carlisle; Kenneth H. Rochow, Ballston Lake, both of N.Y.

[73] Assignee: Environment/One Corporation, Schenectady, N.Y.

[22] Filed: Jan. 30, 1976

[21] Appl. No.: 653,708

[52] U.S. Cl. ..... 241/36; 241/46.02; 52/20; 137/13

[51] Int. Cl.[2] ..... B02C 13/18

[58] Field of Search ..... 241/36, 43, 46 R, 46 B, 241/46.11, 46.17, 101.2, 185 A; 52/20; 137/356, 364, 367, 372

[56] References Cited

UNITED STATES PATENTS

| | | | |
|---|---|---|---|
| 996,956 | 7/1911 | Walcott | 137/367 |
| 3,375,788 | 4/1968 | Solas et al. | 137/364 |
| 3,552,408 | 1/1971 | Dowdican | 137/13 |
| 3,672,103 | 6/1972 | Kost | 52/20 |
| 3,904,131 | 9/1975 | Farrell, Jr. et al. | 241/46.02 |
| 3,938,285 | 2/1976 | Gilba | 52/20 |
| R28,104 | 8/1974 | Grace | 241/36 |

*Primary Examiner*—Granville Y. Custer, Jr.
*Attorney, Agent, or Firm*—Charles W. Helzer

[57] ABSTRACT

A sewage grinder pump and access manway assemblage comprising a lower collection tank having a watertight and airtight cover and at least one sewage grinder pump unit suspended from a top cover plate for the collection tank and extending into the tank for grinding and pumping under pressure sewage collected in the tank. An integral manway housing member fabricated from fiberglass or other similar non-corrosive material is mounted over the collection tank and has enough enclosed space to accommodate a workman. The bottom cross-sectional dimensions of the manway housing member are slightly less than the cross-sectional dimensions of the collection tank. The collection tank has an upper peripheral wall section which coacts with a corresponding lower peripheral wall section of the manway housing member for securing the manway housing member and the collection tank together in a substantially airtight and watertight manner. A substantially weatherproof, removeable top cover closes the top end of the manway housing member with the removeable top cover being vented to a source of atmospheric pressure while in place in a manner such that it does not impair the weatherproof characteristics of the enclosure. The sewage grinder pump unit is suspended from a top cover plate thru an enlarged opening in the top of the collection tank with the top cover plate forming a substantially watertight and airtight closure over the collection tank. A breather vent pipe is connected to the interior of the control housing of the grinder pump unit and extends to the top of the manway housing for venting the control housing to a source of atmospheric pressure.

24 Claims, 5 Drawing Figures

Fig. 1.
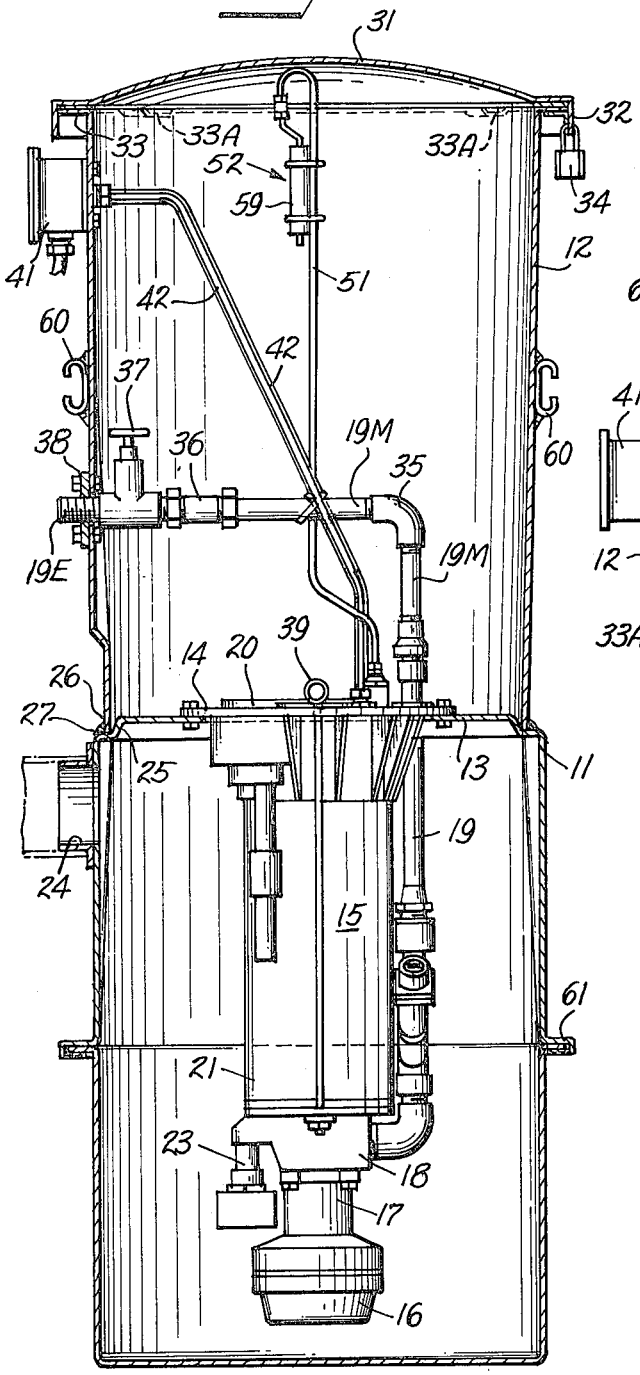
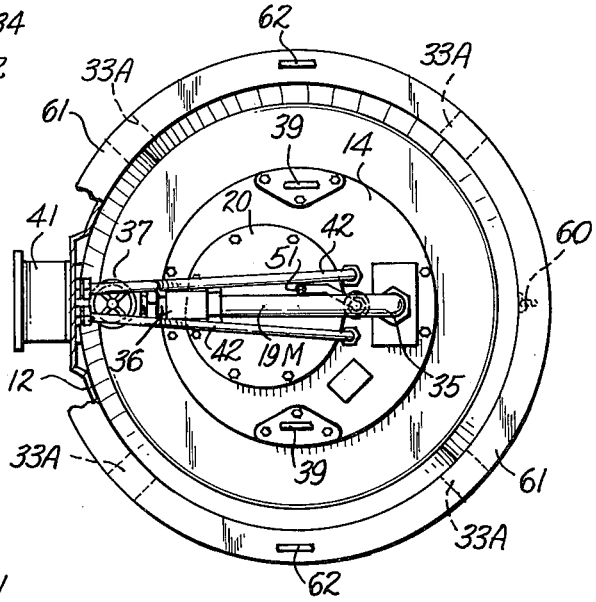
Fig. 2.

COMBINED MANWAY AND COLLECTION TANK FOR SEWAGE GRINDER

BACKGROUND OF THE INVENTION

Field of Invention

This invention relates to a new and improved manway and collection tank assemblage for sewage grinder pumps.

More particularly, the invention relates to a manway and sewage collection tank assemblage for use with sewage grinder pumps installed below-grade outdoors. The assemblage is designed to facilitate proper and easy installation by unskilled field workers without impairment of the watertight integrity of the assemblage yet assuring proper operation and ease of maintenance of the assemblage after installation.

Prior Art Problem

U.S. Pat. No. Re. 28,104 issued Aug. 6,1974 discloses a new and improved sewage grinder pump comprised essentially of a sewage collection tank having a grinder, positive displacement pump and electric motor contained within a liquid-tight and airtight housing all suspended within the collection tank for first grinding and then pumping under pressure sewage collected in the tank. The sewage thus processed is then distributed under pressure through low cost, small diameter, plastic pipes that can follow the contour of the ground to a pressure sewer main for transport to a treatment facility, to a drain field, to a gravity sewer main or the like. The sewage grinder pump may be installed in the basement of a residence, office, factory, school, motel, etc. in much the same manner as any other household appliance such as washers, dryers, etc. or it may be buried under ground (below-grade) in an adjacent front, side or backyard.

Installations requiring the sewage grinder pump to be buried below-grade often times will have high water tables, particularly during wet seasons, so that possible flooding of the unit is a risk. Additionally, many new homes of the split level type, etc. utilize basement level rooms for living purposes and require toilet facilities at this level. To service such facilities it is often necessary to bury the sewage grinder pump at a considerable depth below-grade in order to provide the normal gravity drain grade from the basement level toilet facilities to the collection tank of the sewage grinder pump. With such installations heretofore it has been necessary to provide a concrete pit in which the sewage grinder pump is installed. Such pits are susceptible to flooding where high water tables occur, are comparatively expensive to construct in relation to the overall cost of a sewage grinder pump unit itself, and generally require considerable skill and expertise on the part of the installation crews and hence preclude the use of unskilled workers. To overcome these problems, the present invention was devised.

SUMMARY OF INVENTION

It is therefore a primary object of the invention to provide a new and improved manway and collection tank assemblage for sewage grinder pumps.

Another object of the invention is to provide such an assemblage for installation below-grade outdoors to facilitate proper and easy installation by relatively unskilled field workers without impairment of the watertight integrity of the assemblage and yet assurring proper operation and ease of maintenance of the assemblage after installation.

In practicing the invention, a new and improved sewage grinder pump and access manway assemblage is provided and comprises a lower sewage collection tank having a watertight and airtight top cover plate and at least one sewage grinder pump unit suspended from the top cover plate and extending into the tank for grinding and pumping under pressure sewage collected in the tank. An integral manway housing member defining an enclosed space sufficient to accommodate a workman is supported over the sewage grinder collection tank. The manway housing member has a bottom area with cross-sectional dimensions slightly less than the cross-sectional dimensions of the collection tank and has enlarged openings in the bottom and top ends thereof. The collection tank has an upper peripheral wall section that coacts with a lower peripheral wall section formed on the bottom of the manway housing member that defines the enlarged opening in the bottom end and by means of which the manway housing member is securely supported on the top of the collection tank. A substantially airtight and watertight seal is formed around the juncture of the manway housing member to the collection tank. A substantially weatherproof removeable top cover is provided for closing the top end of the manway housing member. The top cover is designed to provide a means for venting the top of the manway housing member to a source of atmospheric pressure with the top cover in place and without impairing the weatherproof characteristics of the enclosure. The sewage grinder pump unit which is suspended from the top cover of the collection tank has a substantially airtight and watertight control housing within which an electric motor and controls therefor are mounted for driving the grinder and pump. A breather vent pipe is connected from the interior of the control housing and extends upwardly in the manway housing member for venting the control housing to a source of atmospheric pressure and includes a float valve for assuring that no water gets into the control housing even though the manway is flooded.

The collection tank preferably includes a removeable cover plate in the top thereof to which the grinder pump unit is secured for suspension into the collection tank with the removeable cover plate and suspended grinder pump unit being removeable as a unit through the top and bottom openings of the manway housing member. In addition, a second removeable cover plate is located within the first mentioned removeable cover plate to provide access to the control housing of the sewage grinder pump unit which is suspended from the first mentioned removeable cover plate. A small diameter discharge conduit is coupled to the outlet from the grinder pump unit and extends through the removeable cover plate into the manway housing member. From the manway housing member the discharge conduit extends out through a sidewall of the manway housing member for connection to a pressure sewer main. A union coupler and a shut-off valve are disposed within the manway housing member and are connected in the discharge conduit for allowing decoupling of the portion of the discharge conduit extending through the sidewall of the manway housing member whereby the removeable cover plate, suspended sewage grinder pump unit and portion of the discharge conduit passing through the removeable cover plate up to the Dresser coupling unit can be removed as a single integral assembly via the manway housing member bottom and top openings.

The sewage grinder and access manway assemblage may be fabricated in such a manner that an externally extending peripheral flange is formed about the collection tank and access manway assembly to help anchor the assemblage in the ground where buried. Preferably, the sewage collection tank is formed by two substantially matching complimentary tank halves that can be nested one within the other with each of the tank halves having outwardly extending peripheral flanges around the open ends thereof for securing the two halves together to thereby form a peripheral flange extending outwardly and around the periphery of the assembled collection tank midway between the ends thereof and which also can help to anchor the tank and access manway assemblage in the ground where buried.

The sewage grinder pump and access manway assemblage is further constructed to include a watertight electrical junction box secured to the sidewall of the manway housing member for providing prewired electrical connection to the control housing for the sewage grinder pump unit. The wiring from the junction box to the sewage grinder pump unit is provided at the factory so that connections to supply electrical power may be made externally of the assemblage via the watertight electrical junction box without requiring interior access to the manway by field installation personnel. Additionally, a section of small diameter discharge conduit is provided which extends from the union coupler through the shut-off valve and through the sidewall of the manway housing member in a watertight manner for providing plumbing connection to the discharge from the grinder pump unit without requiring that the field installation personnel have access to the interior of the manway. The first removeable cover plate preferably is provided with lifting eyes formed on diametrically opposed sides to allow the cover plate and attached suspended sewage grinder pump unit together with the short section of discharge conduit to be readily lifted as an integral assembly through the open bottom and top ends of the manway housing member. The sewage collection tank and access manway housing members are preferably fabricated from a non-corrosive material such as fiberglass and further include tank lifing eyes secured to the peripheral flange formed around the sewage collection tank for lifting the collection tank and access manway as an assembled unit. To complete the assemblage a float valve is secured in the upper end of the breather vent pipe for selectively passing only air through the breather vent pipe and for closing off the breather vent pipe in the event liquid rises in the manway housing member to the level of the float valve.

The float valve in the breather vent pipe preferably comprises an enlarged diameter cylindrical chamber secured to the vent pipe at one end and open to the atmosphere at the remaining downwardly directed end. A float member is supported within the enlarged diameter cylindrical chamber and has at its upper end a valve seat for closing off the upper end of the enlarged diameter cylindrical chamber whereby the breather vent pipe will be closed upon liquid rising in the access manway housing member to a level sufficient to float the float member and close the valve seat against the opening to the breather vent pipe.

BRIEF DESCRIPTION OF DRAWINGS

These and other objects, features and many of the attendant advantages of this invention will be appreciated more readily as the same becomes better understood by reference to the following detailed description, when considered in connection with the accompanying drawings, wherein like parts in each of the several Figures are identified by the same reference character, and wherein:

FIG. 1 is longitudinal sectional view of a combined collection tank and access manway for sewage grinder pumps constructed in accordance with the invention;

FIG. 2 is a top plan view of the assemblage shown in FIG. 1 with the top cover thereof removed;

DETAILED DESCRIPTION OF PREFERRED EMBODIMENTS

Figure 3:
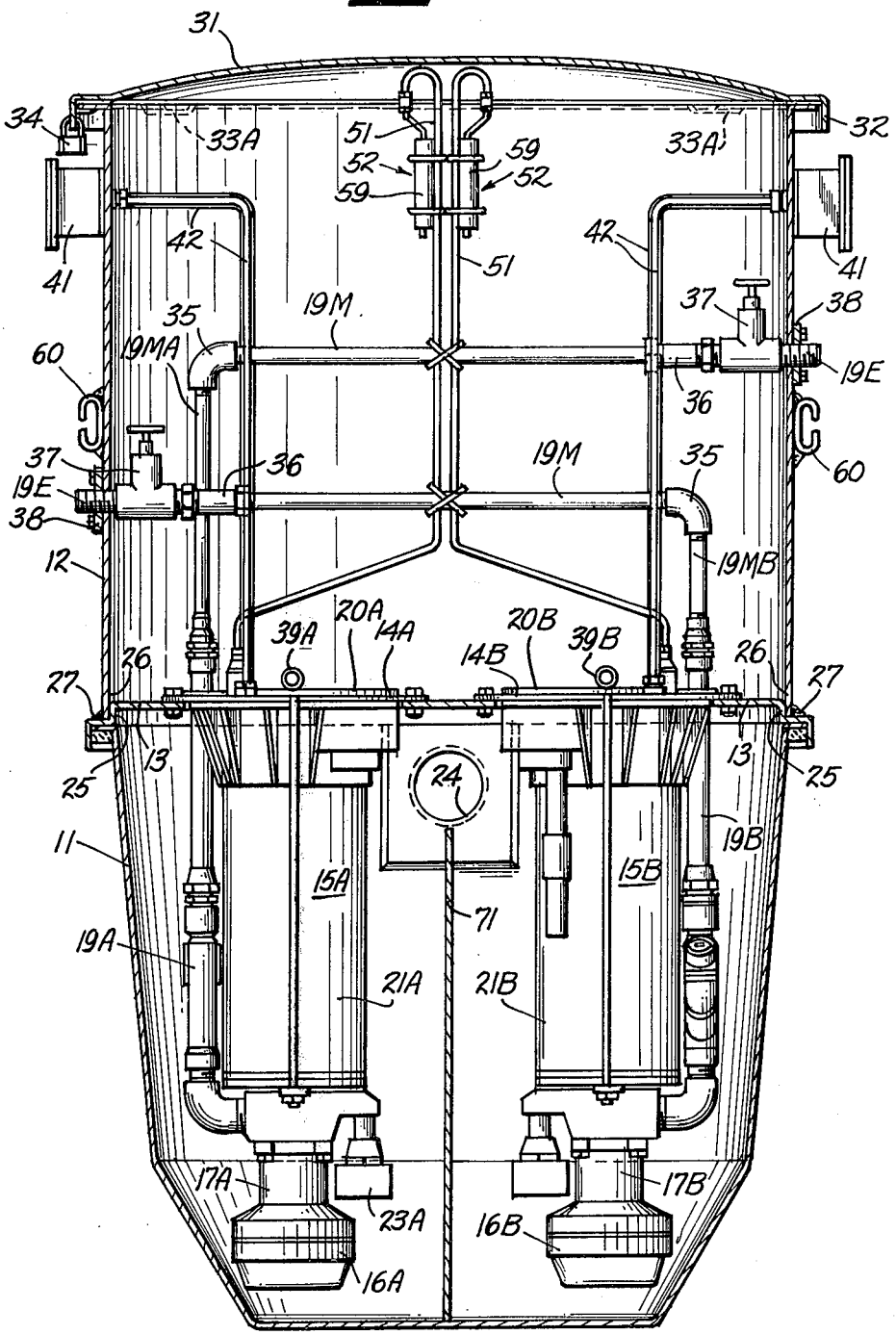
FIG. 3 is a longitudinal sectional view of a second embodiment of a combined dual sewage grinder pump collection tank and access manway assembly constructed in accordance with the invention.
Figure 4:
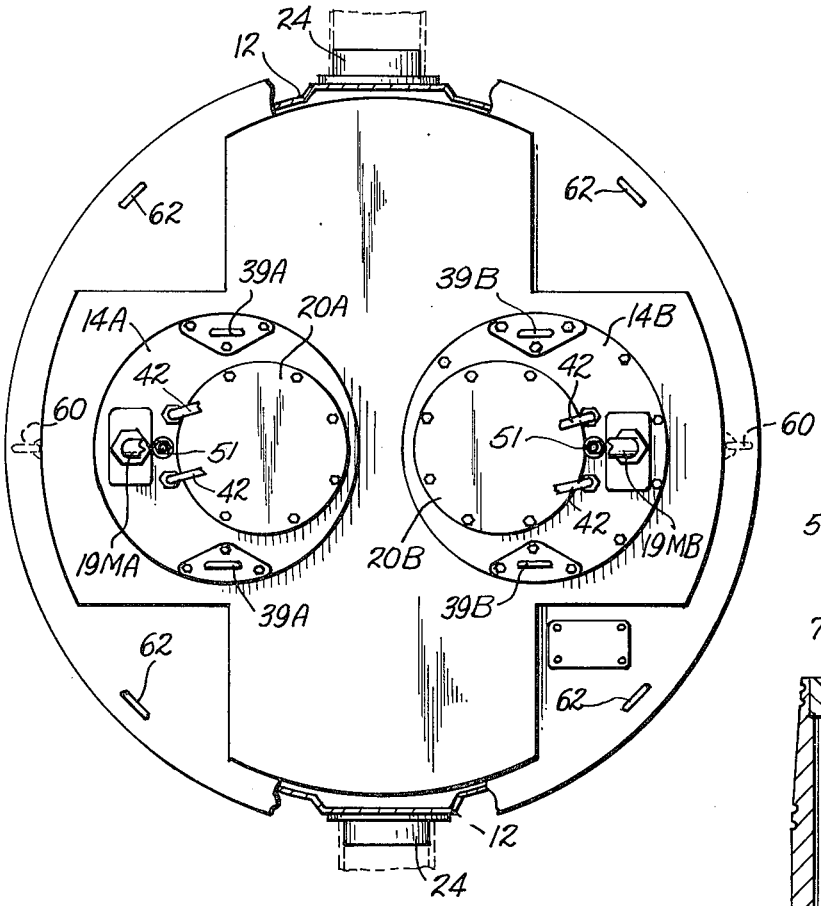
FIG. 4 is a top plan view of the assemblage shown in FIG. 3 with the top cover thereof removed.

FIG. 1 is a longitudinal sectional view of a new and improved sewage grinder pump and access manway assemblage constructed in accordance with the invention. The assemblage shown in FIG. 1 is comprised by a sewage collection tank shown at 11 having an access manway housing member 12 secured to the top thereof. The sewage collection tank 11 includes a top section 13 having an enlarged opening therein over which a first removeable cover 14 is secured in an airtight and watertight manner. Secured to the removeable cover 14 is a grinder pump core unit 15 the construction and operation of which is describe more fully in the above referenced U.S. Pat. No. Re. 28,104. Briefly, however, it should be noted that the grinder pump core unit 15 is comprised of a grinder unit shown generally at 16 which is supported on the intake end of a positive displacement pump shown generally at 17 having a discharge chamber 18 coupled to an outlet discharge conduit 19. An electric motor for driving both the pump 17 and grinder unit 16 is secured within a liguid-tight and airtight control housing 21 along with certain controls such as a pressure actuated switch. The pressure actuated switch responds to variations in pressure produced in a sensing tube shown at 23 due to increases in the level of sewage collected in the sewage collection tank 11 to cause the motor within control housing 21 to turn on upon the level of sewage attaining some predetermined value. The sewage then is ground by the grinder 16 and pumped under pressure by pump 17 through discharge outlet conduit 19. The discharge conduit 19 is then connected in a manner to be described more fully hereinafter to a pressure sewage main or the like for distribution to a sewage treatment plant. Sewage is initially collected in tank 11 through an inlet opening 24 which is connected to the normal gravity outlet of a home, office, motel unit, etc. which in turn is connected to a stack vent pipe so that the interior of the sewage collection tank 11 normally is vented to atmosphere through the stack vent in a well known manner.

The top portion 13 of the sewage collection tank 11 includes a peripherial portion 25 coacting with a peripheral wall section 26 around the bottom of the manway housing member 12 and which defines the enlarged opening in the bottom end of the manway housing member. This bottom opening in the manway housing member has cross-sectional dimensions which are slightly less than the cross-sectional dimensions of the peripheral portion 25 of the top of the collection tank 11 so that the manway housing member may be securely supported on the top of collection tank 11. Means shown at 27 are provided for securing the peripheral wall section of the manway housing member 12 around the peripheral portion 25 formed on the top of the collection tank in a substantially airtight and watertight manner. For this purpose, an epoxy resin or other similar strong bonding and sealing agent may be employed both externally and internally of the juncture to form a rigid watertight and airtight connection of the collection tank 11 and manway housing member 12 at this point.

The manway housing member 12 preferably is an integral structure fabricated from a non-corrosive material such as fiberglass and forms an enclosed space for accommodating a workman with both the upper and bottom ends thereof having enlarged openings. The upper enlarged opening of the manway housing member 12 is closed by a substantially weatherproof moveable top cover 31 having downwardly projecting peripheral skirt sections shown at 32 which project over an outwardly extending top flange portion 33 formed around the top opening in a manway housing member 12. Corrugated passageways 33A are formed at least in certain points around the periphery of the flange portion 13 so as to assure venting of the top of the manway housing member to the atmosphere with the top cover in place but without impairing the weatherproof characteristics of the enclosure. To protect the installation from vandalism, a suitable hasp and lock shown at 34 is also provided for the removeable top cover 31.

As discussed above, the sewage collection tank 11 has an enlarged opening in the top thereof which is closed by cover plate 14 from which the grinder pump core unit 15 is suspended. The manner in which the grinder pump core unit 15 is suspended from cover plate 14 is disclosed more fully in the above-referenced U.S. Pat. No. Re. 28,104. In addition to the main cover plate 14 from which grinder pump core unit 15 is suspended, there is an additional or second removeable cover plate 20 best seen in FIG. 2 of the drawings which provides access to the interior of the control housing 20. For only minor maintenance problems, a repairman can reach through or let himself down into the access manway housing 12 (dependent upon its size and depth), remove the second cover plate 20 and get access to the pressure actuated switch, the electrical motor, or other parts of the grinder pump core unit 15 which might cause minor troubles in service.

The first or main removeable cover plate 14 to which the grinder pump core unit is secured also has the pressure sewer discharge conduit 19 pass through it in a liquidtight and airtight manner so as to extend up through a section 19M disposed within the access manway housing 12. The section 19M is diverted at right angles through an elbow 35 and is connected through a pipe union coupler 36 and shut-off valve 37 both of conventional, commercially available construction, and then passes out through a suitable sealing structure shown at 38 on the sidewall of the manway housing member 12. Sealing structure 38 forms an airtight and watertight seal around the end of the discharge conduit 19E located exteriorally of the manway housing member 12. By this construction, piping connections to discharge conduit from the grinder pump unit can be made by field installation personnel exterior of the assemblage without requiring that such personnel enter the manway.

The portions of the discharge conduit 19M and 19E preferably are of copper with the exterior end portion 19E being adapted to readily receive a coupling for connecting the discharge to a sewage distribution main. By this arrangement, it is possible to decouple the discharge conduit section 19M from the exterior connection 19E by means of the union coupler 36 after shutting shut-off valve 37 and thereafter lift the entire assembly including the removeable cover plate 14, suspended grinder pump core unit 15 and the portions 19 and 19M of the discharge conduit completely up and out through the openings in the top of the collection tank 19 and through the bottom and upper openings of the manway 12 by means of a crane or other suitable tool attached to lifting eyes shown at 39 disposed on opposite sides of the cover plate 14. Thus, if there is some catastrophic failure of the grinder pump core unit 15, it can be removed and replaced with a working unit readily through the access manway. If only minor service problems are encountered, the manway provides adequate space for a repairman to get at the unit through the second removeable cover plate 20. When so engaged, the liquid tight and airtight seal between the collection tank and the manway prevent sewer gasses from collecting in the manway while minor repair work is being performed. Of course, under circumstances where the removeable cover plate 14 and grinder pump core unit is being removed in the above described manner, no such isolation of the sewer gasses is possible.

In order to provide electrical service to the motor in the grinder pump core unit, a watertight electrical junction box shown at 41 is provided and may be secured either to the exterior or the interior of the manway sidewall. The watertight electrical junction box is prewired internally by means of electrical conductors 42 to the electrical motor and controls for the grinder pump core unit 15. Thus, it will be appreciated that the assemblage can be delivered to field installation sites, placed in the ground, and connected up without requiring that relatively unskilled field installation personnel enter the manway to make connections since all electrical and plumbing connections can be accomplished from outside the access manway by reason of the above described design. This is an important advantage both costwise and in assuring proper operation of the equipment after it has been installed.

As noted above, the control housing 21 in which the motor and control for the grinder pump core unit 15 is mounted, is sealed closed in a watertight and airtight manner. In order to assure proper functioning of the electric motor and the controls therefor it is necessary to vent the control housing to a source of atmospheric pressure. For this purpose, a breather vent pipe shown at 51 is provided which leads from the interior of the control housing 21 for grinder pump core unit 15 up to the top of the access manway housing member 12 where it is bent over in the form of a horse shoe or inverted J so that the free end of the breather vent pipe is downwardly directed. Secured to this downwardly directed free end of breather vent pipe 51 is a float valve 52 whose construction and operation will be described more fully hereinafter in connection with FIG. 5. Briefly however, it will be stated that the float valve 52 is for the purpose of closing off the breather vent pipe in the event of flooding of the access manway housing member 12. In-site locations near the shore of lakes which are fed from rivers having a propensity for flooding, or near tidal waters, it is quite possible that flooding will reach a level sufficient to flood the enclosure of the access manway housing 12. In such an event, the float valve 52 will close off the breather vent pipe 51 so as to prevent serious and permanent damage to the interior of the control housing 21 and the motor contained therein.

As best seen in FIG. 1 of the drawings, the sewage collection tank 11 is fabricated from two substantially matching complimentary tank halves which are designed to be nested one within the other for storage purposes. Each of the tank halves have outwardly extending peripheral flanges 61 formed around the open sides thereof for securing the two halves together with an epoxy resin or other watertight and airtight sealing means. When thus joined together, a peripheral flange shown at 61 is formed which extends outwardly around the periphery of the assembled collection tank midway between the ends thereof. This outwardly extending peripheral flange helps to anchor the collection tank and access manway assembly in the ground where it is buried. To facilitate placement of the assemblage in a hole dug in the ground to accommodate it, hooks 60, or tank lifiting eyes shown at 62 in FIG. 2 of the drawings, are provided on diametrically opposed sides of the assemblage whereby a crane, hoist or other suitable lifting apparatus can safely lift and lower the complete assemblage shown in FIG. 1 into a hole in the ground where it is to be accommodated. Since no leakage exteriorally of the collection tank and access manway assemblage is anticipated, no particular kind of backfilling such as gravel, loose sand, etc. is required. The removed earth can be employed in backfilling around the assemblage and will firmly grip the peripheral flanges 61 to help retain the assemblage buried where it is placed. In addition, lifting and restraining hooks, such as shown at 60, may be provided for both lifting and lowering the assembly into the ground, and for securing suitable anchoring cables attached at their remaining end to pegs, spikes or other means of securement.

After placement in the ground in the above briefly described manner, all that is required of the field installation personnel is to dig the shallow trenches for accommodating the small diameter, pressure sewer line to be connected to the outlet opening 19E. Suitable underground electrical cables may also be run in the same trench or a different shallow trench to the electrical junction box 41. Since all interior plumbing, electrical and venting connections previously have been made either at the factory or at an assembly warehouse be experienced, skilled personnel, proper installation of the assemblage with relatively unskilled, low cost field installation personnel and electricians, can be accomplished.

FIG. 3 is a longitudinal sectional view of a modified form of combined sewage collection tank and access manway assemblage according to the invention. The embodiment of the invention shown in FIG. 3 is similar in all major respects and functions in the same manner as the embodiment shown in FIG. 1 with two exceptions. The first exception is that the access manway is considerably shorter in the embodiment shown in FIG. 3. This is to accommodate installations where burial in the ground is somewhat shallower than for the embodiment of the invention shown in FIG. 3. Otherwise the two structures are entirely similar and function in the same manner.

The second major difference between the two embodiments shown in FIGS. 1 and 3, is that the FIG. 3 embodiment illustrates the invention practiced with respect to a duplex sewage grinder pump employing two single sewage grinder pump core units 15A and 15B. The construction and operation of a duplex sewage grinder pump assembly is described more fully in co-pending U.S. application Ser. No. 603,124 filed Aug. 8, 1975, and reference is made to that disclosure for a more complete description of the features of the duplex grinder pump. Briefly, however, it can be stated that the duplex grinder pump in addition to employing two individual independently operating sewage grinder core units 15A and 15B, also utilizes a central dividing partition 71 which divides the enlarged collection tank 11 into two separate parts. The inlet opening to the sewage collection tank shown at 24 is disposed immediately over this central partition 71 so that the partition serves as a baffle to divide flow equally between the two sewage collection chambers formed by the impervious barrier 71. Each of the collection chambers thus comprised includes its own independent and individually operating sewage grinder pump core unit 15A and 15B each of which turn on and off to pump out collected sewage in the identical manner to the grinder pump core unit shown in FIG. 1. It will be noted however, that the dividing partition 71 is somewhat below the tank inlet opening 24. Thus, should one of the sewage grinder pump core units 15A or 15B fail in service, sewage directed to its particular half of the collection tank will overflow the impervious barrier and be disposed of by the remaining, opeating sewage grinder pump core unit. Thus, it will be appreciated that the assembly provides a redundant backup pumping capability which will accommodate outage of one of the units. Needless to say, suitable alarms are provided to indicate that one unit is not operating and that all of the sewage load is being processed by the remaining unit. This alarm will signal a maintenance man who can then repair the non-operating unit and place it back in service.

Figure 5:
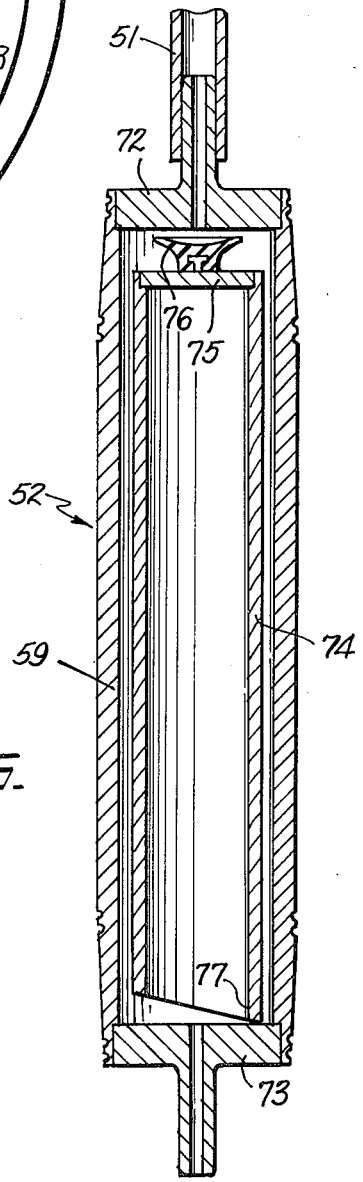
FIG. 5 is a longitudinal sectional view of a float valve construction suitable for use with the assemblage shown in FIGS. 1 and 3 of the drawings.

FIG. 5 is a longitudinal sectional view of a preferred construction for the float valve assembly used in the breather vent pipe of both FIG. 1 and FIG. 3 embodiments of the invention. As shown in FIG. 5, the float valve 52 is comprised by an enlarged diameter cylindrical chamber 59 having open ends closed by end members 72 and 73 each of which has a centrally formed stem through which a passageway is formed. The stem of the end member 72 is connected to the downwardly projecting end of the breather vent pipe 51 as best seen in FIG. 1 of the drawings. A cylindrically shaped float member 74 of smaller diameter than the chamber 59 is disposed within chamber 59 for movement therewithin. The end of the float chamber 74 adjacent closure member 72 secured to the breather vent pipe 51 is sealed closed with a generally circular end plate 75 on which is mounted a valve seat 76. The remaining opposite end of float member 74 adjacent the circular end member 73 may have an elongated extension shown at 77 which prevents float member 74 from sealing off air flow through the central passageway of the stem of circular end member 73 into the interior of the enlarged diameter chamber 71. The entire structure may be fabricated from a suitable non-corrosive plastic material of relatively low cost with the proviso that the valve seat 76 be sufficiently flexible to assure sealing off of the passageway through the circular end member 72 into the breather vent pipe 51.

In operation, the float valve of FIG. 5 functions in the following manner. It should be recalled that the float valve is disposed with the end thereof not attached to breather vent pipe 51 extending downwardly in the vertical position. It will be appreciated therefore that when thus mounted, the float member 74 always will be seated in the position shown in FIG. 5 whereby an air passageway is provided through the structure into the breather vent pipe 51. In the event of flooding, water or other liquid entering through the central passageway in the stem of the lower most closure member 73 will trap air in the inner float member 74. This will cause the float member 74 to rise and close off the passageway through the end member 72 into the breather vent pipe 51. In this manner, it is assured that water or other liquid will not be allowed to enter into the control housing of the sewage grinder pump unit through the breather vent pipe 51.

From the foregoing descripition, it will be appreciated that the present invention provides a new and improved manway and collection tank assemblage for sewage grinder pumps. The assemblage may be installed below grade outdoors and is designed to facilitate proper and easy installation by relatively unskilled field workers without impairment of the watertight characteristics of the assemblage and yet assuring proper operation and ease of maintenance of the assemblage after installation.

Having described two different embodiments of a combined manway and collection tank for sewage grinder pump constructed in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. A new and improved sewage grinder pump and access manway assemblage comprising a lower collection tank having a watertight and airtight top cover plate and at least one sewage grinder pump unit suspended from the top cover plate and extending into the tank for grinding and pumping under pressure sewage collected in the tank, an integral manway housing member defining an enclosed space for accommodating a workman and supported over said collection tank, said manway housing member having a bottom area with cross-sectional dimensions slightly less than the cross-sectional dimensions of the upper portion of said collection tank and having enlarged openings in the bottom and top ends thereof, said collection tank having an upper peripheral wall section coacting with a lower peripheral wall section on the bottom of the manway housing member that defines the enlarged opening in the bottom end thereof for securely supporting said manway housing member on the top of the collection tank, means for securing the peripheral wall section defining the opening in the bottom end of said manway housing member around the upper peripheral wall section of said collection tank in a substantially airtight and watertight manner, a substantially weatherproof removeable top cover closing the top end of said manway housing member, means for venting the upper end of said manway housing member to a source of atmospheric pressure with the top cover in place without impairing the watherproof characteristics of the enclosure, said sewage grinder pump unit suspended from the top cover plate of said collection tank having a substantially airtight and watertight control housing within which an electric motor for driving the grinder pump and controls therefor are mounted, and breather vent pipe means connected to the interior of the control housing of said grinder pump unit and extending to the upper end of said manway housing member for venting said control housing to a source of atmospheric pressure.

2. A sewage grinder pump and access manway according to claim 1 wherein there is a removeable cover plate in the top of the collection tank to which the grinder pump unit is secured for suspension into the collection tank, the removeable cover plate and suspended grinder pump unit being removeable as a unit through the top and bottom openings of the manway housing member and having lifting means formed thereon.

3. A sewage grinder pump and access manway according to claim 2 further including a second removeable cover plate located within the first mentioned removeable cover plate and providing access to the control housing of the sewage grinder pump unit suspended from the first mentioned removeable cover plate.

4. A sewage grinder pump and access manway according to claim 1 further including a removeable cover plate providing access to the control housing of the sewage grinder pump unit suspended from the top cover of the collection tank.

5. A sewage grinder pump and access manway according to claim 2 further including a small diameter discharge conduit coupled to the outlet from the grinder pump unit and extending through the removeable cover plate into the interior of the manway housing member and thence out through a side wall of the manway housing member for connection to a pressure sewer main, a union coupler and a shut-off valve disposed within the manway housing member and connected in the discharge conduit for allowing decoupling of the portion of the discharge conduit extending through the side wall of the manway housing member whereby the removable cover plate, suspended sewage grinder pump unit and portion of the discharge conduit passing through the removeable cover plate up to the union coupler can be removed as a single integral assembly via the manway housing member bottom and top openings.

6. A sewage grinder pump and access manway according to claim 3 further including a small diameter discharge conduit coupled to the outlet from the grinder pump unit and extending through the removeable cover plate into the interior of the manway housing member and thence out through a sidewall of the manway housing member for connection to a pressure sewer main, a union coupler and a shut-off valve disposed within the manway housing member and connected in the discharge conduit for allowing decoupling of the portion of the discharge conduit extending through the sidewall of the manway housing member whereby the removeable cover plate, suspended sewage grinder pump unit and portion of the discharge conduit passing through the removeable cover plate up to the union coupler can be removed as a single integral assembly via the manway housing member bottom and top openings.

7. A sewage grinder pump and access manway according to claim 1 wherein an externally extending peripheral flange is formed about the collection tank and access manway housing member at their juncture to help anchor the assembly in the ground where buried.

8. A sewage grinder pump and access manway according to claim 6 wherein an externally extending peripheral flange is formed about the collection tank and access manway housing member at their juncture to help anchor the assembly in the ground where buried.

9. A sewage grinder pump and access manway according to claim 1 wherein the sewage collection tank is formed by two substantially matching complimentary tank halves that can be nested one within the other and with each of the tank halves having outwardly extending peripheral flanges around the open end thereof for securing the two halves together to thereby form a peripheral flange extending outwardly around the periphery of the assembled collection tank midway between the ends thereof and which helps to anchor the tank and access manway in the ground where buried.

10. A sewage grinder pump and access manway according to claim 8 wherein the sewage collection tank is formed by two substantially matching complimentary tank halves having outwardly extending peripheral flanges around the open end thereof for securing the two halves together to thereby form a peripheral flange extending outwardly around the periphery of the assembled tank midway between the ends thereof and which helps to anchor the tank and access manway in the ground where buried.

11. A sewage grinder pump and access manway according to claim 5 further including a watertight electrical junction box secured to the sidewall of the manway housing member in a watertight manner and prewired to the control housing of the sewage grinder pump unit and a section of small diameter discharge conduit extending from the union coupler through the shut-off valve and through a watertight seal in the sidewall of the manway housing member for providing electrical connections and a plumbing connection to the discharge from the grinder pump and without requiring that field installation personnel have access to the interior of the manway.

12. A sewage grinder pump and access manway according to claim 10 further including a watertight electrical junction box secured to the sidewall of the manway housing member and prewired through the interior of the manway to the control housing for the sewage grinder pump unit and a section of small diameter discharge conduit extending from the union coupler through the shut-off valve and through a watertight seal in the sidewall of the manway housing member for providing electrical connections and a plumbing connection to the discharge from the grinder pump unit without requiring that field installation personnel have access to the interior of the manway, said first removeable cover plate having lifting eyes formed on diametrically opposed sides thereof to allow the cover plate and attached suspended sewage grinder pump unit together with the short section of discharge conduit to be readily lifted as an integral unit through the open bottom and top ends of the manway housing member and wherein the sewage collection tank and access manway housing member are fabricated from a non-corrosive material such as fiberglass, and further including tank lifting means secured around the periphery of the sewage collection tank for lifting the collection tank and access manway as an assembled unit.

13. A sewage grinder pump and access manway according to claim 1 further including float valve means secured in the upper end of the breather vent pipe means for selectively passing only air through said breather vent pipe means and for closing off the breather vent pipe means in the event of liquid rising in the manway housing member to the level of the float valve means.

14. A sewage grinder pump and access manway according to claim 12 further including float valve means secured in the upper end of the breather vent pipe means for selectively passing only air through said breather vent pipe means and for closing off the breather vent pipe means in the event of liquid rising in the manway housing member to the level of the float valve means.

15. A sewage grinder pump and access manway according to claim 1 wherein the sewage collection tank and manway housing member are fabricated from a non-corrosive, lightweight, structurally strong material such as fiberglass, and said breather vent pipe means comprises a relatively small diameter, lightweight, non-corrosive pipe extending from the control housing upwardly through the manway housing member and bent over near the top cover thereof in an inverted J-shaped manner so as to define a downwardly extending portion, and a float valve secured in the downwardly extending portion of the inverted J-shaped end of the breather vent pipe.

16. A sewage grinder pump and access manway according to claim 12 wherein the sewage collection tank and manway housing member are fabricated from a non-corrosive, lightweight, structurally strong material such as fiberglass, and said breather vent pipe means comprises a relatively small diameter, lightweight, non-corrosive pipe extending from the control housing upwardly through the manway housing member and bent over near the top cover thereof in an inverted J-shaped manner so as to define a downwardly extending portion, and a float valve secured in the downwardly extending portion of the inverted J-shaped end of the breather vent pipe.

17. A sewage grinder pump and access manway according to claim 15 wherein the float valve comprises an enlarged diameter cylindrical chamber secured to the vent pipe at one end and open to the atmosphere at the remaining downwardly directed end, a float member supported within the enlarged diameter cylindrical chamber and having at the upper end thereof a valve seat for closing off the upper end of the enlarged diameter cylindrical chamber whereby the breather vent pipe will be closed upon liquid rising in the access manway housing member to a level sufficient to float the float member and close the valve seat against the opening to the breather vent pipe.

18. A sewage grinder pump and access manway according to claim 16 wherein the float valve comprises an enlarged diameter cylindrical chamber secured to the vent pipe at one end and open to the atmosphere at the remaining downwardly directed end, a float member supported within the enlarged diameter cylindrical container and having at the upper end thereof a valve seat for closing off the upper end of the enlarged diameter cylindrical container whereby the breather vent pipe will be closed upon liquid rising in the access manway housing member to a level sufficient to float the float member and close the valve seat against the opening to the breather vent pipe.

19. A manway for a sewage grinder pump comprising an integral manway housing member defining an enclosed space for accommodating a workman and having enlarged openings in the bottom and top ends thereof, the bottom peripheral area of the housing member defining the bottom opening having cross-sectional dimensions slightly less than the cross-sectional dimensions of the top of the sewage grinder pump collection tank with which the manway is designed to be used, said bottom peripheral area having a lower peripheral wall section for coacting with an upper peripheral wall section of the collection tank to form a substantially watertight and airtight seal therewith while firmly supporting the manway housing member in place on the top of the collection tank, the enlarged opening in the bottom and top of the manway being sufficiently large to accommodate passage of an assemblage comprising a removeable top cover plate for the top of the sewage collection tank and attached grinder pump unit suspended therefrom, a substantially weatherproof removeable top cover closing the top end of said manway housing member, and means for venting the top end of said manway housing member to a source of atmospheric pressure with the top cover in place without impairing the weatherproof characteristics of the enclosure.

20. A manway for a sewage grinder pump according to claim 19 wherein the integral manway housing member is fabricated from a non-corrosive, lightweight, structurally strong material such as fiberglass.

21. A manway for a sewage grinder pump according to claim 20 further including watertight electrical and plumbing utility fixtures secured to the manway housing member and designed for preconnection to the sewage grinder pump unit for allowing the coupling of both electrical and plumbing service through the preconnected utility fixtures without requiring that field installation personnel enter the interior of the manway housing member to assure proper installation of the assembly.

22. A manway according to claim 21 further including breather vent pipe means having a float valve therein connected to the manway for ready connection to a sewage grinder pump unit control housing.

23. A manway according to claim 19 wherein open corrugations are formed in the juncture between the removeable top cover and the top end of said manway for venting the top end of the manway to the atmosphere.

24. A manway according to claim 22 wherein open corrugations are formed in the juncture between the removeable top cover and the top end of said manway for venting the top end of the manway to atmosphere.

* * * * *